US007060009B2

(12) United States Patent
Greenleaf

(10) Patent No.: US 7,060,009 B2
(45) Date of Patent: Jun. 13, 2006

(54) BICYCLE ROLLER BALANCE DEVICE

(76) Inventor: Mark Stanley Greenleaf, 4 Round Hill Rd., Foster, RI (US) 02825

( * ) Notice: Subject to any disclaimer, the term of this patent is extended or adjusted under 35 U.S.C. 154(b) by 444 days.

(21) Appl. No.: 10/408,074

(22) Filed: Apr. 7, 2003

(65) Prior Publication Data

US 2004/0198562 A1 Oct. 7, 2004

(51) Int. Cl.
*A63B 69/16* (2006.01)

(52) U.S. Cl. ..... 482/61; 482/54

(58) Field of Classification Search ..... 482/14, 482/35, 36, 38, 41, 42, 51, 54, 57, 66, 148, 482/908, 61; 119/700
See application file for complete search history.

(56) References Cited

U.S. PATENT DOCUMENTS

| | | | | |
|---|---|---|---|---|
| 187,477 | A * | 2/1877 | Medart | 482/41 |
| 3,871,525 | A * | 3/1975 | Al-Dabbagh et al. | 211/191 |
| 3,905,597 | A * | 9/1975 | Tabb | 482/61 |
| 4,095,561 | A * | 6/1978 | Ruetenik | 119/700 |
| 4,114,873 | A * | 9/1978 | Jones | 482/42 |
| 4,205,628 | A * | 6/1980 | Null | 119/700 |
| 4,342,452 | A * | 8/1982 | Summa | 482/54 |
| 4,708,337 | A * | 11/1987 | Shyu | 482/54 |
| 4,902,000 | A * | 2/1990 | Starks et al. | 482/41 |
| 6,010,432 | A * | 1/2000 | Vawter | 482/54 |
| 6,168,548 | B1 * | 1/2001 | Fleming | 482/23 |
| 6,464,619 | B1 * | 10/2002 | Bondi | 482/35 |
| 6,719,668 | B1 * | 4/2004 | Huang | 482/54 |
| 6,736,760 | B1 * | 5/2004 | Lee | 482/54 |

* cited by examiner

*Primary Examiner*—Stephen K. Cronin
*Assistant Examiner*—Tam Nguyen

(57) ABSTRACT

Stationary bicycle riding on conventional bicycle rollers is enhanced and rendered safer by the use of this Bicycle Roller Balance Device. The sought after balancing characteristics of roller riding are unaffected; the rider enjoys complete freedom of movement within the width of the rollers, while at the same time is prevented from the perils of traveling off the sides of the rollers. This is accomplished by a system of curbs and bumpers. The curbs are near-vertical components that deflect an errant bicycle wheel back toward the center of the rollers. The bumpers are padded surfaces that deflect the rider back toward the center as well. Furthermore, stepping platforms are provided to aid the rider in more safely mounting and dismounting the bicycle. The device is self-contained and modular in nature, and can be assembled or disassembled readily by the user.

3 Claims, 6 Drawing Sheets

NOTE: PARTS 20,21,22,23,24 ARE NOT PART OF THE INVENTION, BUT ARE SHOWN FOR ILLUSTRATIVE PURPOSES ONLY. (SEE SPECIFICATION)

BICYCLE ROLLER BALANCE DEVICE

BACKGROUND OF THE INVENTION

1. Field of the Invention

This invention relates in general to bicycle training apparatus, and in particular to bicycle roller training apparatus.

2. Prior Art

In order to provide background information so that the invention may be completely understood and appreciated in its proper context, reference is made to the background of the field, and to a number of prior art patents as follows:

Bicycle rollers consist of three parallel drums on which a conventional bicycle is placed for the purpose of stationary exercise and training. Ideally, there is no positive connection between the bicycle rollers and the bicycle. While there are several types of apparatus in which one can use his conventional bicycle for stationary riding, rollers present the rider with a clear advantage over those types—that is, rollers most closely simulate non-stationary, outdoor riding by requiring the rider to balance and steer the bicycle. This is accomplished through the setup of the drums; the rear two drums are positioned such that the rear wheel of the bicycle is cradled, thereby resisting forward movement of the bicycle. The third, front drum is positioned directly under the front wheel, and is driven by a belt connected to the rear drums, thereby forcing it to spin. This spinning effect is what causes the rider to be able to balance the bicycle; i.e. the relative movement of the drums and bicycle is the same as that between road and bicycle for outdoor riding. S. A. Sturgis in U.S. Pat. No. 581,835 further describes these concepts.

Being able to balance and steer the bicycle during stationary training results in more realistic and enjoyable stationary riding, thereby providing encouragement for a continuing training program. It also results in improved bicycle handling skills. While these advantages over other training apparatus may be clear, many are hesitant to use bicycle rollers for training. This is due to two inherent drawbacks of such a system: 1) With conventional bicycle rollers, steering the bicycle too far to either side will result in the bicycle dropping off the ends of the drums. Since the bicycle wheels would be spinning at a rapid rate at this moment, upon contact with the adjacent floor the bicycle and rider would be propelled across the room, out of control, or the rider would simply tip over on his side, or both. 2) Reaching the ground when mounting or dismounting a bicycle can be difficult, due to the height of the bicycle's top horizontal tube, and the several inches of added height due to the bicycle rollers. Also, mounting and dismounting the bicycle has been rendered more difficult with the advent of the "clipless pedal system". Such a widely adopted pedal system effectively hitches one's shoes to the pedals, resulting in more efficient pedal action. However, this system can make mounting and dismounting the bicycle a tricky endeavor.

The above drawbacks result in hesitancy in many bicyclists who have never tried to use rollers. It also is a concern of more experienced bicyclists, as prolonged riding on rollers can cause fatigue and momentary loss of concentration; even a very brief loss of concentration by an experienced rider can result in excessive sideways movement off the sides of the drums.

These drawbacks have been widely recognized, and many prior art patents have been developed as attempts at mitigation. All of these attempts have failed, either by not successfully mitigating the drawbacks, or by overly restricting the freedom of movement of the bicycle, thereby eliminating the main advantage of using rollers. Mitigation by the prior art generally falls within one of the following two categories: 1) limit the potential sideways movement of the bicycle, without restricting the balancing characteristics, and 2) limit the potential sideways movement of the bicycle while restricting the balancing characteristics. The former category is certainly the more desirable of the two; if successful, the patent would render the roller system safe, without infringing on its advantages. However, no patent has yet to succeed in this endeavor. Prevention of excess sideways movement of the bicycle wheels on the drums generally results in the added potential peril of the bicycle and its rider tipping over, rather than riding off the side; in essence, one drawback has been solved, but another has been created. The latter category has resulted from the lack of a solution to the former. However, restriction of the bicycle's balancing characteristics eliminates one of the major benefits of the rollers to begin with.

S. A. Sturges in U.S. Pat. No. 581,835 developed rollers with platforms alongside the roller drums, at the same level as the top of the drums. These platforms compensate for the raised height of the roller system, but do little more. While preventing the immediate drop-off of the bicycle to the floor upon excess sideways movement of the bicycle, the rider would still be propelled forward with this system, and the potential for tipping still exists. Therefore, this patent did not overcome the cited drawbacks.

L. F. Guignard in U.S. Pat. No. 463,862 developed concave drums (i.e., of a varying diameter, smaller at the center and larger at the outsides of the drums), which encourage the bicycle wheel to stay toward the center of the drums. These concave drums provide minimal protection from riding off the sides, restrict the freedom of movement of the bicycle, provide no protection against tipping, and offer no mounting or dismounting advantages.

G. W. Tarver in U.S. Pat. No. 602,546 added devices that connected the bicycle to the roller system, thereby restricting the bicycle's balancing characteristics.

H. W. Hapman in U.S. Pat. No. 2,534,967 used the combined effects of concave rollers and connection devices from the bicycle to the roller system, thereby restricting the bicycle's balancing characteristics.

L. M. Tabb in U.S. Pat. No. 3,905,597 provided platforms in an attempt to mitigate the mounting/dismounting drawback, but offered no solution to the disadvantage of riding laterally off of the drums.

J. R. Berkes (U.S. Pat. No. 4,082,265), S. Smith (U.S. Pat. No. 4,415,152), G. Cassini, F. Grassi, and R. Prevedelli (U.S. Pat. No. 4,580,983), S. Kim (U.S. Pat. No. 4,925,183), F. Defaux (U.S. Pat. No. 4,932,651), and O. Vasques (U.S. Pat. No. 5,662,559) all added devices that connected the bicycle to the roller system, similar to Tarver, but with the added benefit of not completely restricting the sideways movement of the bicycle. However, even this partial restriction is an undesirable effect for the rider, as it results in adversely effecting the freedom of the rider to balance the bicycle. Also, no attempt is made at mitigating the mounting/dismounting problems.

T. Werner (U.S. Pat. No. 6,500,098) took a somewhat different approach from most of the others, by refining the effects of Guignard's concave drums. Recognizing the disadvantage of varying drum diameter, Werner created a drum that is uniform in diameter over the wide mid-section of the drums, thereby eliminating the restriction of movement resulting from concave drums. Werner's drums increase sharply in diameter at their ends, thereby creating, in effect, a "stop" at these ends, preventing the bicycle from riding off the ends of the drums, and redirecting the wheels back toward the center of the drums. While this method best satisfies the desire to minimize the restriction of movement of the bicycle, it creates an additional undesirable effect; if the rider were to ride up against the ends of the drums, the lateral restriction of these "stops" would cause the rider to pivot outward about the base of the wheel, thereby tipping over on to the adjacent floor surface.

It can be seen from the above references that preference has been given by most inventors to restricting the sideways movement with attachments to the bicycle, at the expense of the freedom of movement that makes roller riding so enjoyable and beneficial. The remaining inventors have opted toward less restrictive means, but have not solved the inherent problems of the roller system. Attempts at effectively mitigating both of the cited drawbacks, while retaining all of the benefits of the roller system have failed in all cases.

BRIEF SUMMARY OF THE INVENTION

It is generally recognized that the benefits of bicycle rollers over other types of stationary bicycle systems are clear: rollers most closely simulate non-stationary, outdoor riding by requiring the rider to balance and steer the bicycle. It also results in improved bicycle handling skills. However, these advantages inherently result in safety disadvantages that discourage the use of bicycle rollers by both novice and experienced riders. These disadvantages are 1) difficulty in keeping the bicycle and rider situated within the narrow width of the roller drums without falling off the edges or tipping over, and 2) difficulty in mounting and dismounting the bicycle, due to the height of the combined bicycle and roller system.

The principal object of the present invention is to retain all of the stated benefits of conventional bicycle rollers, while overcoming the two cited safety drawbacks; i.e. providing completely unrestricted and safe movement of the bicycle and rider within, but not beyond the width of the drums, and providing an appropriate means of safely mounting and dismounting the bicycle.

The foregoing objectives can be accomplished by providing a device comprising 1) a curb system at a level just above and on either side of the top of the drums for containing the bicycle wheels within the width of bicycle roller drums in the event of contact, 2) a bumper system at roughly shoulder height on each side of the rider for containing the bicycle rider, and 3) platforms on either side of the rider and bicycle to aid in mounting and dismounting the bicycle.

In the preferred embodiment of the invention, a frame made of tubular or similar sections on which conventional bicycle rollers, a bicycle (both not a part of this invention), and a bicyclist are supported, is provided to connect together each of the aforementioned components and to prevent the entire system from tipping over in the event of contact by the bicycle and/or rider. The curb system and platforms are combined in a curb/platform assembly, comprising plates mounted at an oblique angle to the vertical position and situated at a height just above the drums. This assembly also comprises two horizontal platforms on each side; the lower level platforms are situated just above the tops of the drums, and the upper level ones at a height conveniently accessible while seated on the bicycle. The bumper system, or upright bumper assembly, is situated at about shoulder height, comprising padded barriers on either side of the rider. The present invention is intended to accommodate most of the typical bicycle rollers available presently in the marketplace.

DETAILED DESCRIPTION OF THE INVENTION

Figure 1:
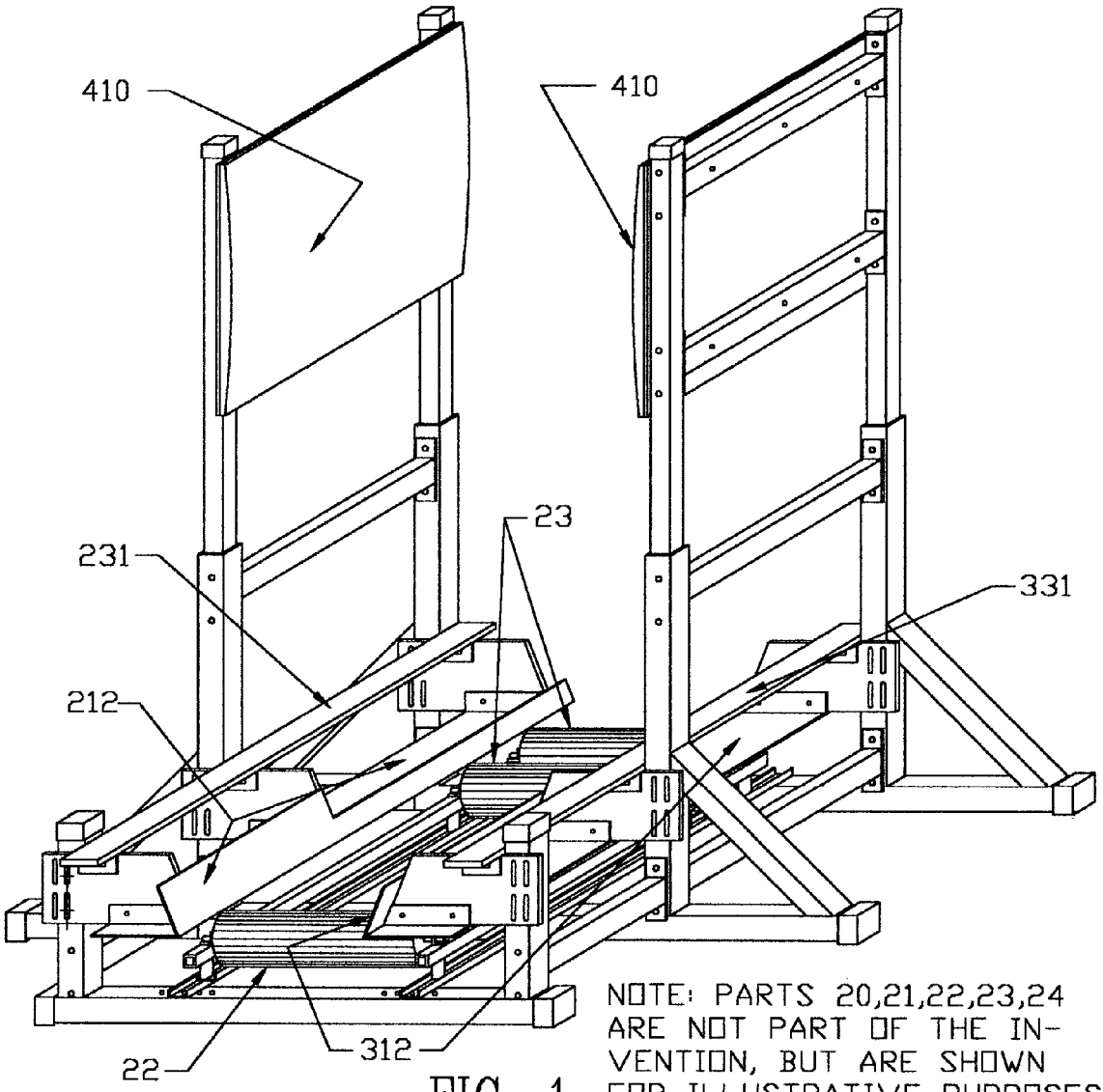
FIG. 1 is an overall three-dimensional perspective view of a device made in conformance with the present invention.
Figure 2:
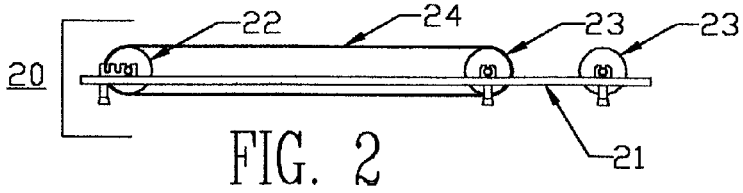
FIG. 2 is a side elevation view of typical bicycle rollers.
Figure 3:
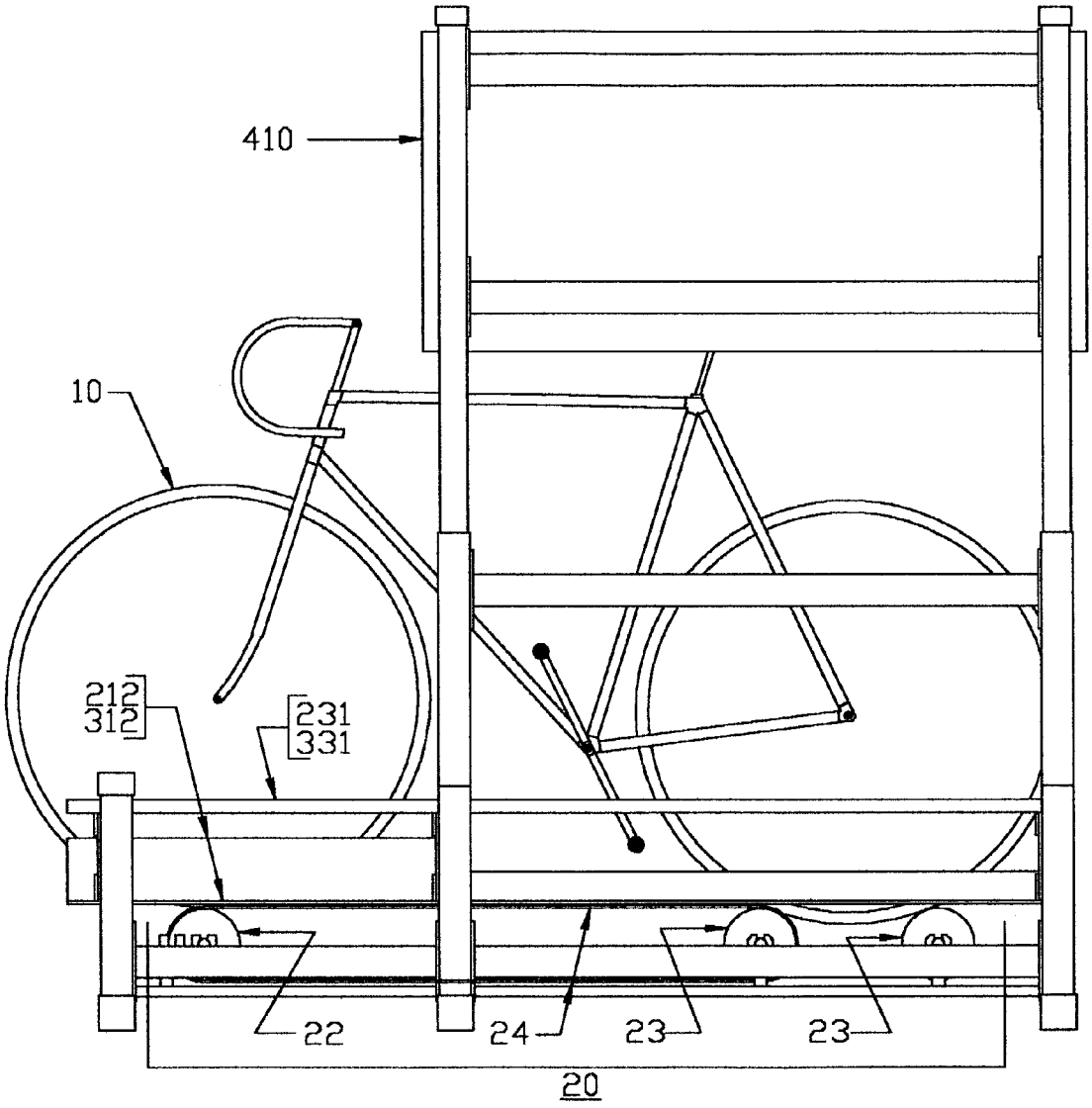
FIG. 3 is a side elevation view of the present invention with typical bicycle rollers and bicycle in place.

As shown in the drawings, the preferred embodiment of the bicycle roller balance device in accordance with the present invention comprises a frame (for supporting conventional bicycle rollers, a bicycle, and a rider), two platform/curb assemblies, and two upright bumper assemblies. FIG. 1 shows the preferred embodiment of the invention, along with typical bicycle rollers (not a part of the present invention). FIG. 2 shows an elevation view of bicycle rollers (20) for reference. FIG. 3 shows a side elevation of the preferred embodiment of the present invention, with bicycle rollers (20) and bicycle (10) in place. In order to fully describe the present invention, a description of conventional bicycle rollers and its primary components is warranted.

FIG. 2 shows that bicycle rollers (20) consist of a frame (21) upon which is supported a front drum (22), which is parallel to two supported rear drums (each 23), all generally of equal width and diameter. FIG. 3 shows that the rear wheel of the bicycle (10) is cradled between the rear two drums (23) of the bicycle rollers (20). The front wheel of the bicycle (10) is centered over the front drum (22). As the rider pedals the bicycle (10), causing its rear wheel to turn, the contact with the two rear drums (23) causes them to turn in the opposite direction. The belt (24) connecting the rear drum (23) to the front drum (22), causes the front drum to spin as well. This results in turning of the front wheel of the bicycle, which allows for the bicycle to be ridden as though it were being balanced during conventional outdoor riding.

FIGS. 1 and 3 show that if a bicycle rider were to ride too close to the edge of the narrow drums (22, 23), his bicycle wheel would come in contact with the curb plate (212, 312) on either side, and be safely deflected back toward the center of the drums. Furthermore, since this wheel contact might result in tipping of the rider outward from the center of the bicycle rollers, two padded bumpers (each 410) are provided to safely contain the rider within the confines of the bicycle rollers. To aid the rider in mounting and dismounting his bicycle, two levels of platforms are provided. The upper level platforms (231, 331) are provided at a height convenient to the rider from a sitting position on his bicycle. The lower level platforms (the horizontal portion of 212, 312) are provided at a height convenient for accessing the upper level platforms, or for mounting/dismounting the bicycle. The function of the remaining components of the present invention, as described in the following paragraphs, is generally to support and/or to connect together the main components described above.

Figure 4:
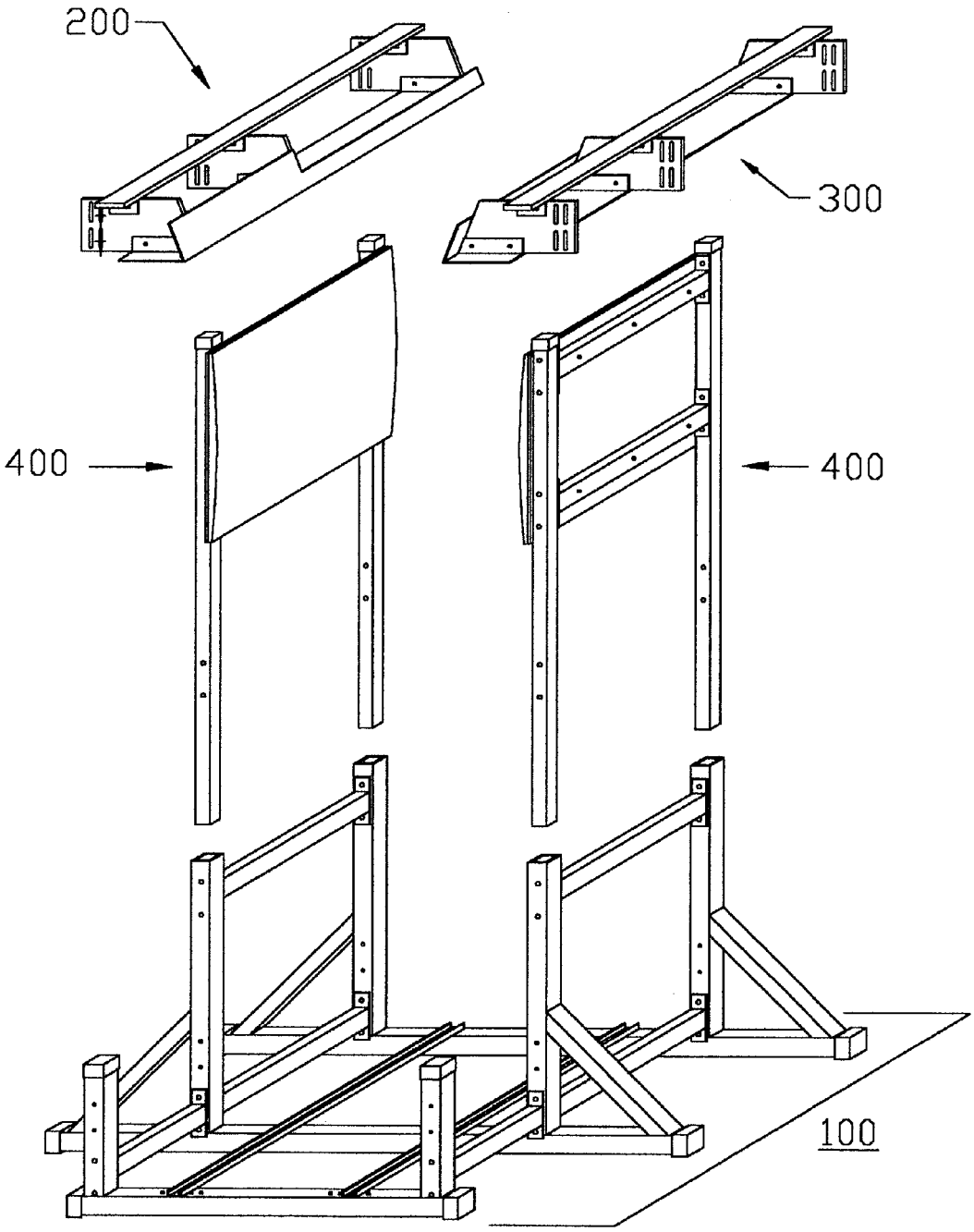
FIG. 4 is an exploded three-dimensional perspective view of the present invention.

FIG. 4 shows an exploded view of the present invention's aforementioned principle components, those being a frame (100), two platform/curb assemblies (200 right and 300 left), and two upright bumper assemblies (each 400). The frame (100) acts to support the other components, the bicycle rollers, the bicycle, the rider, and serves to prevent the entire system from tipping over in the event of contact with the bicycle or rider. The weight of the bicycle rollers, bicycle, and rider serve to counteract this overturning force. The platform/curb assemblies (200, 300) serve to retain the bicycle wheels and provide platforms upon which the rider can step. The upright bumper assemblies serve to contain the rider within the confines of the bicycle rollers.

Figure 5:
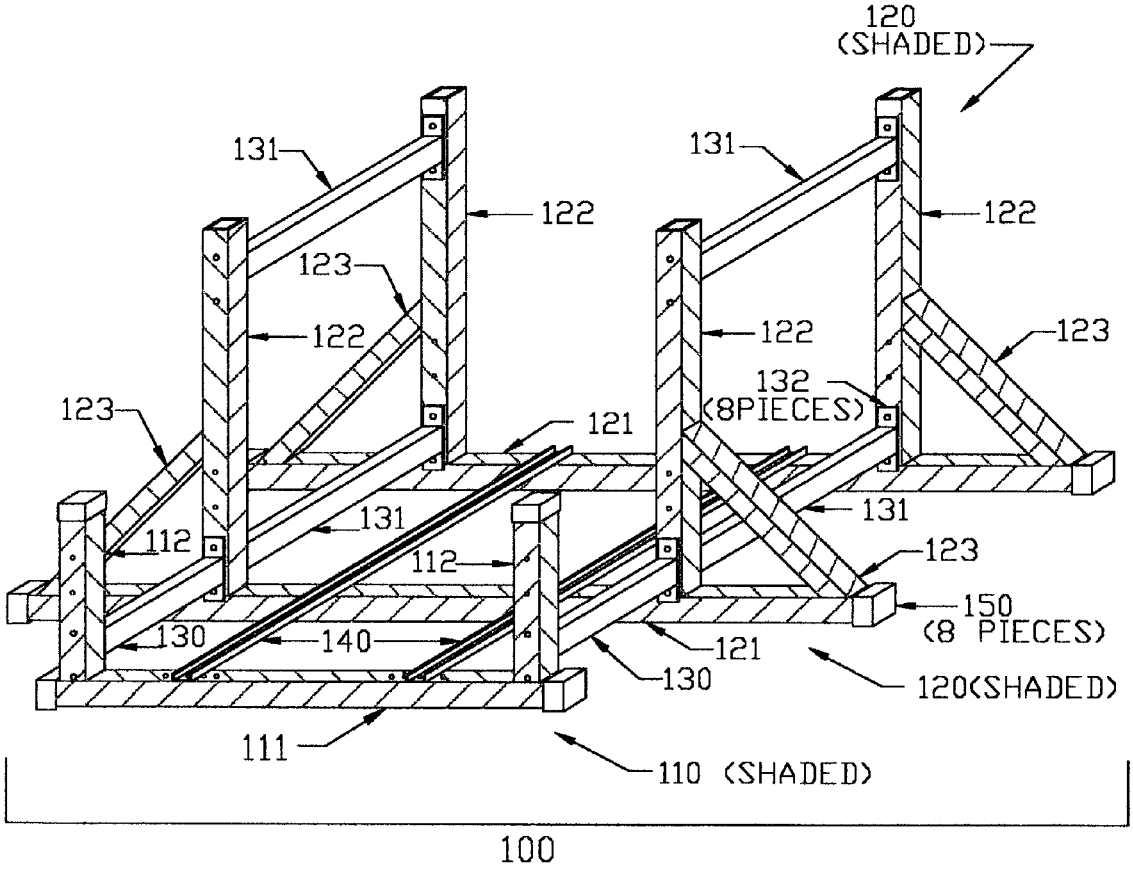
FIG. 5 is a partial three-dimensional perspective view of the base frame.

FIG. 5 shows an enlarged view of the preferred embodiment of the frame (100). The frame comprises three subframes. The front subframe (shaded 110) provides support for the front of the bicycle roller support channels (140), and the curb/platform assemblies (FIG. 4, 200, 300). The bottom horizontal member (111) supports the channels (140), and the upright members (each 112) support the curb/platform assemblies (FIG. 4, 200, 300).

The middle and rear subframes (each shaded 120) also provide support for the bicycle roller support channels (140) and the curb/platform assemblies (FIG. 4, 200, 300). In addition, these middle and rear subframes (120) provide resistance to overturning of the entire assembly due to contact by the rider. This resistance is provided by the extension of the horizontal members (each 121) outboard of the upright members (each 122), and also provided by the diagonal stiffener members (each 123). The upright members (122) provide a connection for the upright bumper assemblies (FIG. 4, 400) and the diagonal members (123).

The three subframes are connected together via short horizontal struts (each 130) and long horizontal struts (each 131). Connection plates (132) are provided at the ends of all horizontal struts.

The channels (each 140) provide support for the legs of the bicycle rollers (see FIG. 1). The exposed ends of all horizontal and vertical members are capped with plastic end caps (150) to protect the rider.

Figure 6:
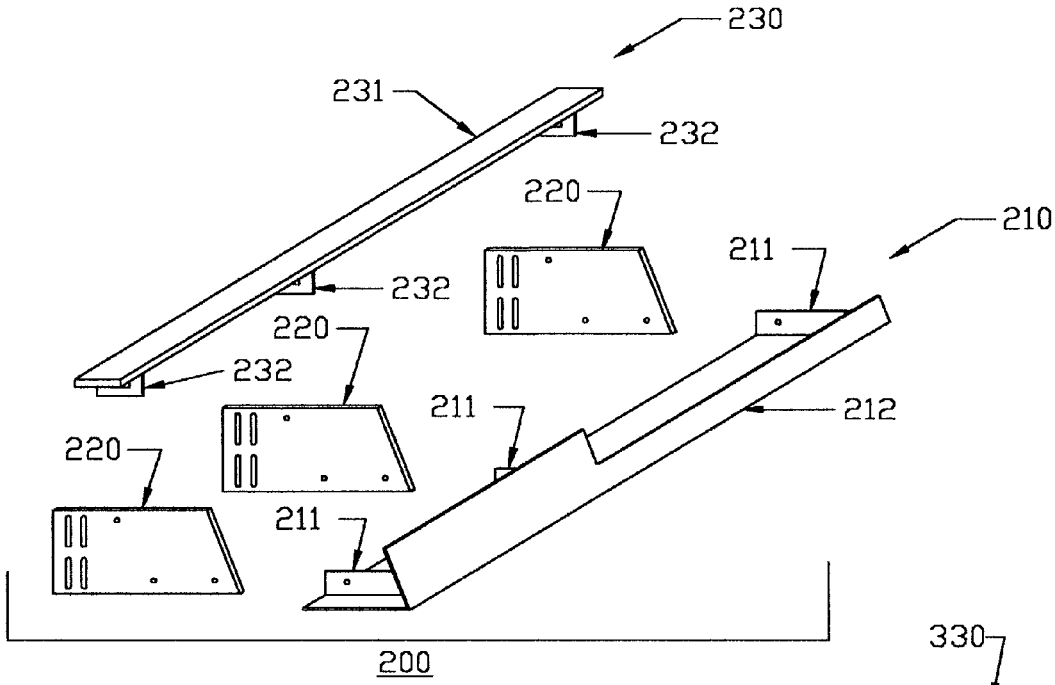
FIG. 6 is an exploded partial three-dimensional perspective view of the right platform/curb assembly.

FIG. 6 shows an exploded view of the right curb/platform assembly (200). Angled connection plates (220) are provided to connect the curb/lower platform assembly (210) and the upper platform assembly (230) to the frame depicted in FIG. 5 and described above. The curb/lower platform assembly (210) comprises three connection plates (each 211), and the bent curb/platform plate (212). The bent curb/platform plate varies in height; the height at the front of the plate is higher than the rear, as it needs to be to adequately contain the front wheel. The height toward the middle and rear of this plate is decreased so as not to interfere with the pedaling action of the rider. The upper platform assembly (230) comprises three connection plates (each 232), and the upper platform plate (231). As an option, plastic edge guards could be provided on all exposed edges for protection of the rider. Also, non-slip rubber pads could be adhered to the platforms. These two options are not shown in the figure.

Figure 7:
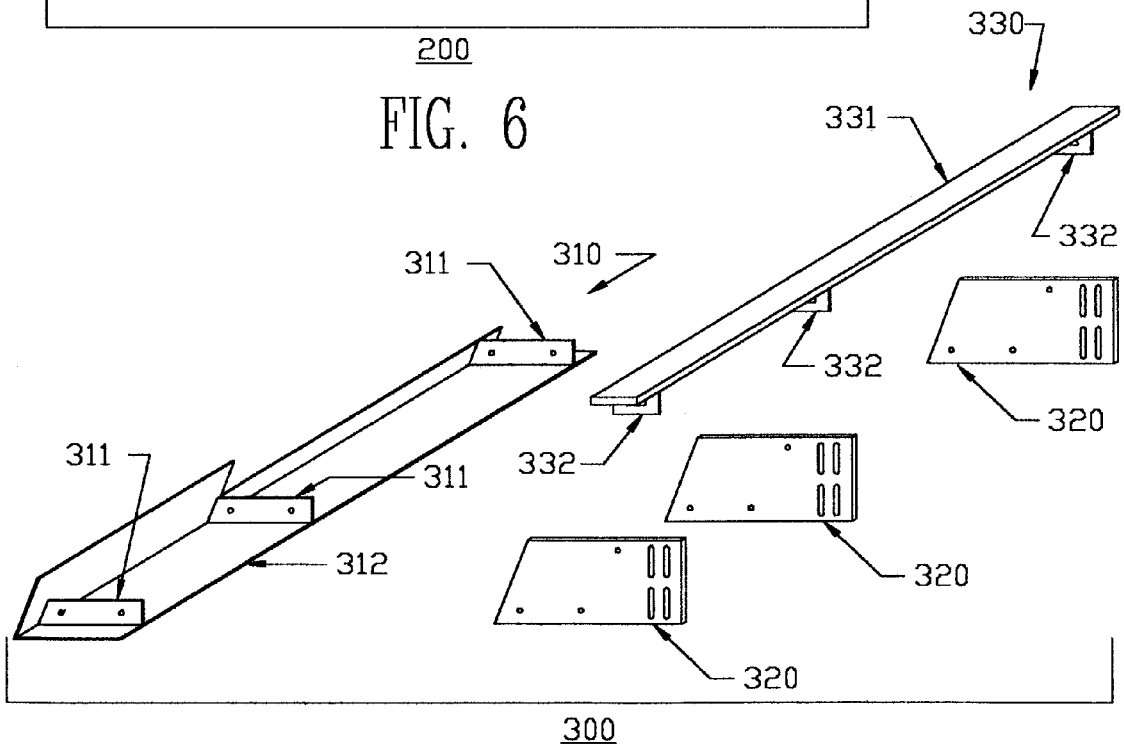
FIG. 7 is an exploded partial three-dimensional perspective view of the left platform/curb assembly.

FIG. 7 shows an exploded view of the left curb/platform assembly (300). This assembly is a mirror image of the previously described right curb/platform assembly (200). However, a full description will be provided for consistency. Angled connection plates (320) are provided to connect the curb/lower platform assembly (310) and the upper platform assembly (330) to the frame depicted in FIG. 5 and described above. The curb/lower platform assembly (310) comprises three connection plates (each 311), and the bent curb/platform plate 312). The upper platform assembly (330) comprises three connection plates (each 332), and the upper platform plate (331). Similar to 200, the height of the bent curb plate varies to accommodate the pedaling action of the rider. Also similar to 200, as an option, plastic edge guards could be provided on all exposed edges for protection of the rider. Also, non-slip rubber pads could be adhered to the platforms. These two options are not shown in the figure.

Figure 8:
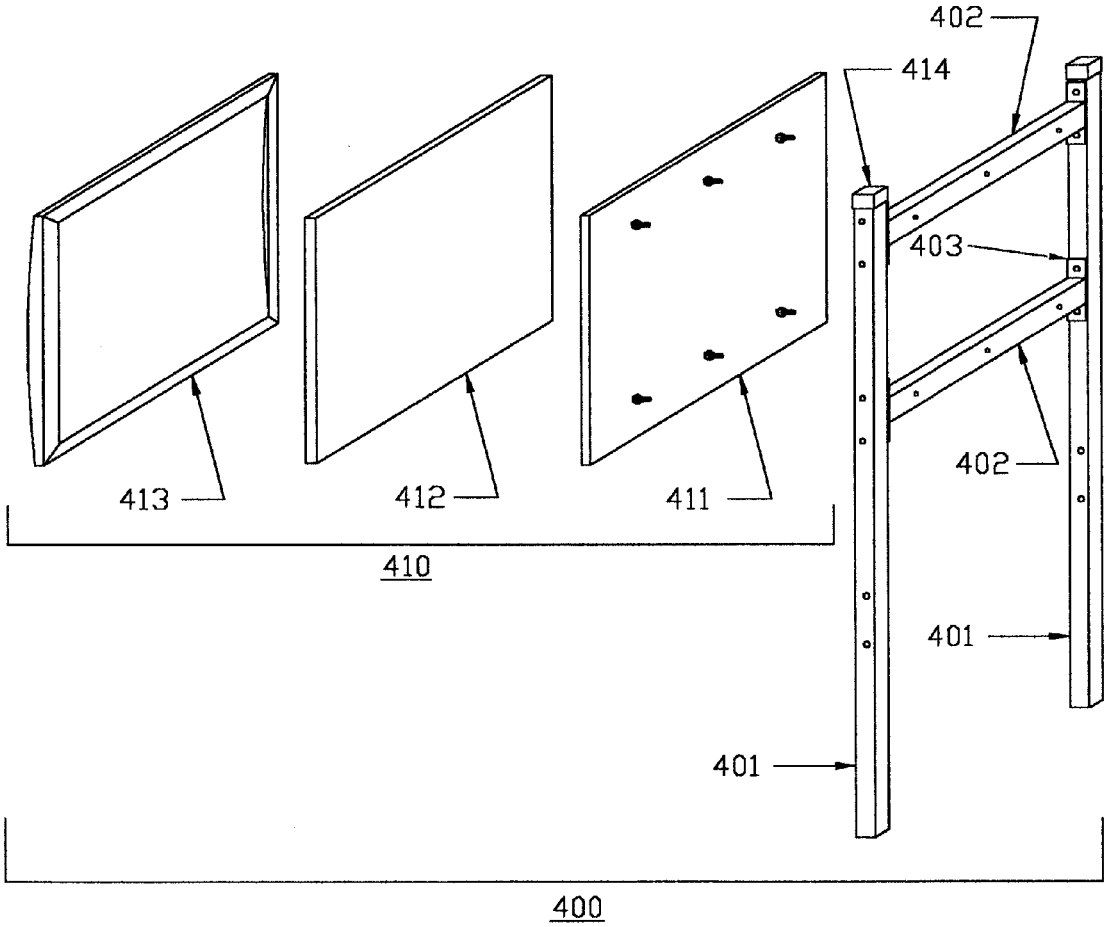
FIG. 8 is an exploded partial three-dimensional perspective view of the upright bumper assembly.

FIG. 8 shows an exploded view of one of the two upright bumper assemblies (each 400). Since these two assemblies are identical, only one need be shown. This assembly comprises two upright support members (each 401) that fit inside the upright members of the frame (FIG. 5, 122). These upright members (401) are connected together by two horizontal struts (each 402, similar to FIG. 5, 121), via end connection plates (each 403, similar to FIG. 5, 132). Plastic end caps (414) on the exposed ends of each upright support members (401) provide protection for the rider. Attached to the horizontal struts (402) is a bumper assembly (410), comprising a backer board (411) of thin plywood or similar material, foam padding (412), and a vinyl cover (413).

The invention is modular in nature, rendering it easy for packing, transport, and assembly. The user would fasten most of the connections during assembly. It is anticipated that assembly would be made with the use of screws and bolts, nuts and washers in the holes shown in the attached Figures. The exceptions to bolting would be 110, 120 (FIG. 5), 210, 230, 310, 330 (FIGS. 6 & 7), and all the horizontal strut-to-endplate connections (130, 131—FIGS. 5 and 403, 403—FIG. 8), which would preferably be welded. It should be noted, however, that these connections could be adapted to bolting as well. Assembly 410 (FIG. 8) would be pre-assembled—the vinyl cover (413) would be stapled to the backer board (411), thereby enclosing the foam pad (412). All of the plastic end caps would be slid onto the exposed member ends, via a snug fit.

Assembly would be performed preferably in the following order:

1. (Reference FIG. 5)—The pre-assembled subframes (110, 120) are joined together with the horizontal struts (130, 131). The upper-most struts (131 and associated 132) are installed later in step 4. The channels (140) are screwed to the subframes. The plastic endcaps (150) are installed.
2. (Reference FIGS. 6, 7)—The pre-assembled curb/lower platform assemblies (210, 310) and upper platform assemblies (230, 330) are connected to the angled connection plates (220, 320).
3. (Reference FIG. 8)—The upright members (401) are joined via the horizontal struts (402) and the end plates (403). The pre-assembled bumper assembly (410) is connected to the horizontal struts. The plastic endcaps (414) are installed.
4. (Reference FIG. 4)—The curb/platform assemblies (200, 300) are attached to the frame assembly (100), via the slotted (adjustable) holes in the plates. The upright members of the bumper assemblies (each 400) are slid down inside the upright members of the frame (100), and the upper horizontal struts of the frame (FIG. 5, 131, 132) are installed, thereby connecting the upright members of the bumper assembly as well.
5. (Reference FIG. 1)—The bicycle rollers are slid onto the channels (FIG. 5, 140), until they are centered within the present invention.

6. Adjustments are made to fit the invention to the particular bicycle rollers via the multiple slotted connection holes in the connections plates (FIGS. 6 & 7, 220 & 320). These multiple slotted holes allow for both lateral and vertical adjustment of the curb/platform assemblies (FIG. 4, 200 & 300) to adjust these assemblies such that they are as close to the bicycle roller drums (FIG. 1, 22 & 23) as possible, but without touching.

In use, the rider would place his bicycle (FIG. 3, 10) on the bicycle system roller drums (FIG. 3, 22 & 23). There is no connection between any component of the present invention and the bicycle or rider. He would then step on the floor within the bicycle roller system, and while holding the bicycle handlebars, would step up on either of the lower or upper platforms (FIG. 1, 212, 312, 231, 331) and mount the bicycle. While seated on the bicycle, he would be able to steady himself with one foot on an upper platform while placing the other foot on a pedal. Then, while leaning against on of the bumper assemblies (FIG. 1, 410), he would be able to place the other foot on its pedal, and begin riding.

Preferably, the overall width of the middle and rear subframes (FIG. 5, shaded 123) would be at least 68 inches to prevent overturning of the invention upon hard contact by the rider. The length of the present invention would preferably be at least 60 inches, in order to accommodate a majority of the common bicycle rollers on the market. The overall height to the top of the bumper assemblies (FIG. 1, 410) would preferably be 62 inches, to accommodate riders of all reasonable sizes.

As described, the present invention fulfllls the objectives; those being to provide a safe environment for the use of bicycle rollers, without restricting the sideways movement of the bicycle or the rider within the width of the bicycle roller drums. Other past inventors have attempted to fulfill these objectives, without success. This is because either the movement of the rider or bicycle was restricted by the invention, or the invention did not prevent the bicycle or rider from drifting too far to the sides of the bicycle rollers, or both. Also, the present invention mitigates the problem of mounting and dismounting the bicycle; something others before have not accomplished in concert with the other objectives. These objectives are achieved by providing padded bumpers at about shoulder height of the rider and curbs at the level of the bicycle wheels, both to limit the sideways movement of the bicycle and rider within the confines of the width of the bicycle roller drums. Also, platforms are provided to aid in the mounting/dismounting of the bicycle.

All of the components of the preferred embodiment of the present invention are made of metal, such as aluminum alloy, except as otherwise previously described. Certain components, such as curb plates and platform plates could alternatively be made of plastic or wood. While the preferred embodiment shows square metal tubes for the basic structure members, alternatives exist which would achieve the same effect. Generally, any commercially available structural shape, fabricated in the same layout as shown would constitute an appropriate alternative. These alternative shapes would include, but not be limited to, structural "L-shaped" angles, "C-shaped" channels, rectangular tubes, etc.

In the preferred embodiment, each of the three pairs of main components that satisfy the objectives of the invention (those being the curb plates, the platform plates, and the upright bumper assemblies) are connected as one unit via the frame. Alternatively, the curb plates or the platform plates, or both, could be separate, self-standing assemblies with a similar shape and function to the preferred embodiment. Also, the preferred embodiment shows the weight of the bicycle rollers, bicycle, and rider being supported on the frame. This is preferred because of the counteracting characteristics of this weight against the tendency for the system to overturn due to a sideways impact of the rider. While preferred, it is not essential that the frame support these components for the invention to function properly. The result of not providing this support would be greater width of the frame, or independent counterweight devices. Furthermore, the functions of the curb plates and the upright bumper assemblies are to satisfy the same objective; that being to prevent excessive sideways movement of the bicycle/rider. The platform plates, however, satisfy another independent objective of providing safe means for mounting and dismounting the bicycle. While both objectives are related to safe use of the bicycle rollers, the former should be considered the more essential of the two. Therefore, it can be said that another alternative embodiment would by to provide the curb plates and upright bumper assemblies, without the mounting platforms—a less desirable, but feasible alternative that satisfies at least the most essential objective.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

I claim:

1. A bicycle roller balance device arranged to support conventional bicycle rollers to provide a safe environment for the use of a free-standing bicycle to permit the bicycle to be operated in a self-balanced and self propelled manner thereon, the device comprising a frame;

a pair of angled curb plates adjustably attached to the frame such that when a conventional bicycle roller is placed on the frame and a bicycle is placed on drums of the roller, the curb plates are horizontally and vertically adjustable to be positioned adjacent to a top portion of the drums on each side of the roller; and a pair of upright bumper assemblies, each attached to the frame outboard and above a respective curb plate;

wherein the curb plates safely deflect the bicycle's wheels back onto said drums when a rider maneuvers the bicycle too far left or right on the roller, and the bumpers serve as a barrier for safely preventing a rider from tipping over as a consequence of the wheels' contact with the curb plates.

2. A bicycle roller balance device arranged to support conventional bicycle rollers to provide a safe environment for the use of a free-standing bicycle to permit the bicycle to be operated in a self-balanced and self propelled manner thereon, the device comprising a frame;

a pair of angled curb plates adjustably attached to the frame such that when a conventional bicycle roller is placed on the frame and a bicycle is placed on drums of the roller, the curb plates are horizontally and vertically adjustable to be positioned adjacent to a top portion of the drums on each side of the roller;

a pair of platform plates, having either one or two heights relative to the curb plates, located horizontally on the frame outboard of the curb plates to allow for a bicycle rider to safely mount or dismount a bicycle on the roller: and a pair of upright bumper assemblies, each attached to the frame outboard and above a respective platform plate;

wherein the curb plates safely deflect the bicycle's wheels back onto said drums when a rider maneuvers the bicycle too far left or right on the roller, and the bumpers serve as a barrier for safely preventing a rider from tipping over as a consequence of the wheels' contact with the curb plates.

3. A bicycle roller balance device arranged to support conventional bicycle rollers to provide a safe environment for the use of a free-standing bicycle to permit the bicycle to be operated in a self-balanced and self propelled manner thereon, the device comprising a frame;

a pair of angled curb plates adjustably attached to the frame such that when a conventional bicycle roller is placed on the frame and a bicycle is placed on drums of the roller, the curb plates are horizontally and vertically adjustable to be positioned adjacent to a top portion of the drums on each side of the roller;

a pair of platform plates, having either one or two heights relative to the curb plates, attached to the frame horizontally outboard of the curb plates to allow for a bicycle rider to safely mount or dismount a bicycle on the roller: and a pair of upright bumper assemblies, each attached to the frame outboard and above a respective platform plate;

wherein the curb plates safely deflect the bicycle's wheels back onto said drums when a rider maneuvers the bicycle too far left or right on the roller, and the bumpers serve as a barrier for safely preventing a rider from tipping over as a consequence of the wheels' contact with the curb plates.

* * * * *